US007230369B2

(12) United States Patent
Kanao

(10) Patent No.: US 7,230,369 B2
(45) Date of Patent: Jun. 12, 2007

(54) SPARK PLUG

(75) Inventor: Keiji Kanao, Chita-gun (JP)

(73) Assignee: Denso Corporation (JP)

( * ) Notice: Subject to any disclaimer, the term of this patent is extended or adjusted under 35 U.S.C. 154(b) by 428 days.

(21) Appl. No.: 10/990,988

(22) Filed: Nov. 18, 2004

(65) Prior Publication Data

US 2005/0116598 A1 Jun. 2, 2005

(30) Foreign Application Priority Data

Nov. 28, 2003 (JP) ..... 2003-399930

(51) Int. Cl.
*H01T 13/20* (2006.01)

(52) U.S. Cl. ..... 313/141; 313/118; 313/143; 313/144; 313/145; 123/169 EL; 123/145 A; 123/145 R; 123/635

(58) Field of Classification Search ..... 313/141–145
See application file for complete search history.

(56) References Cited

U.S. PATENT DOCUMENTS 6,680,561 B2 * 1/2004 Yamaguchi et al. ..... 313/118

FOREIGN PATENT DOCUMENTS

JP 5-55489 7/1993
JP 09219273 A * 8/1997

* cited by examiner

*Primary Examiner*—Nimeshkumar D. Patel
*Assistant Examiner*—Sikha Roy
(74) *Attorney, Agent, or Firm*—Nixon & Vanderhye PC

(57) ABSTRACT

A spark plug includes a metal shell, an insulator, a center electrode, a ground electrode, and a terminal fixed to the insulator. The dimensional parameters in the structure of the spark plug, such as a maximum diameter A of the terminal and a diameter B of the insulator satisfy a dimensional relationship defined through experimental investigation. The structure facilitates an attachment of a plug cap to the spark plug.

13 Claims, 4 Drawing Sheets

SPARK PLUG

CROSS REFERENCE TO RELATED APPLICATION

This application is based on Japanese Patent Application No. 2003-399930 filed on Nov. 28, 2003, the disclosure of which is incorporated herein by reference.

FIELD OF THE INVENTION

The present invention relates to spark plugs for internal combustion engines. More particularly, the invention relates to a dimensional relationship between an insulator and a terminal fixed to the insulator for connection to an ignition coil.

BACKGROUND OF THE INVENTION

Spark plugs generally include a metal shell, an insulator, a center electrode, and a ground electrode.

The metal shell has a threaded portion on outer periphery for fitting the spark plug into a combustion chamber of an engine.

The insulator has a bore formed therein. The insulator is fixed in the metal shell so that a first end thereof protrudes from a first end of the metal shell and a second end thereof protrudes from a second end of the metal shell.

The center electrode is secured in the bore so that a first end thereof protrudes from the first end of the insulator.

The ground electrode is joined to the metal shell. The ground electrode is opposed to the center electrode through a spark gap therebetween.

A terminal is partially inserted in the insulator bore and is fixed on the second end of the insulator. A first end of the terminal is connected to a second end of the center electrode in the bore. A second end of the terminal protrudes from the second end of the insulator so that an ignition coil can connect to the second end of the terminal.

The above mentioned spark plug is inserted into a plug hole of an engine and is fixed to the plug hole with the threaded portion of the metal shell so that the spark gap is disposed in a combustion chamber of the engine.

In recent years, since the engine has been downsized for facilitating installation, it has become more popular to insert the ignition coil, which connects to the spark plug for providing high voltage, into the plug hole.

The terminal and the insulator protruded from the metal shell are inserted into the plug cap of the ignition coil, so that the ignition coil is connected to the spark plug in the plug hole. The ignition coil provides high voltage to the center electrode through the terminal.

It is important to facilitate the attachment of the plug cap to the spark plug. However, the attachment of the plug cap to the spark plug in the plug hole is often not smooth, because the plug cap is attached to the spark plug deep in the plug hole, which is itself narrow.

A spark plug having a small diameter insulator is proposed in Japan unexamined utility model publication No. H5-55489. However, that spark plug does not effectively facilitate the attachment.

Furthermore, there is a large diameter difference between the terminal and the second end side of the insulator, a step portion formed by the diameter difference prevents the plug cap from attaching smoothly. Simply enlarging an inner diameter of the plug cap facilitates the attachment of the plug cap. However, if the contact between the spark plug and the plug cap is insufficient, spark discharge will occur at the second end side of the insulator. Such spark discharge is called flashover. It is an undesirable phenomenon in which spark discharge occurs between the metal shell and the terminal through the clearance formed by the spark plug and the plug cap.

SUMMARY OF THE INVENTION

It is, therefore, an object of the present invention to provide a spark plug having an improved structure which capable of facilitating the attachment of the plug cap by minimizing the diameter difference between the terminal and the insulator so that the step portion formed by the terminal and the insulator is minimized.

According to one aspect of the invention, there is provided a spark plug which comprises:

a metal shell having a first end and a second end, the metal shell also having a threaded portion on an outer periphery thereof;

an insulator having a first end and a second end, the insulator also having a bore formed therein, the insulator being fixed in the metal shell so that the first end of the insulator protrudes from the first end of the metal shell and the second end of the insulator protrudes from the second end of the metal shell;

a center electrode secured in the bore of the insulator, the center electrode having a first end protruding from the first end of the insulator and a second end;

a ground electrode joined to the first end of the metal shell so that the ground electrode is opposed to the center electrode through a spark gap;

a terminal having a first end and a second end, the terminal being partially inserted into the bore and fixed to the insulator so that the first end of the terminal electrically connects to the second end of the center electrode and the second end of the terminal protrudes from the second end of the insulator; and wherein an absolute value of a diameter difference represented by $|B-A|$ is equal to or less than 0.6 mm, where A is a maximum diameter of a protruding portion of the terminal, protruded from the second end of the insulator, and B is a diameter of a protruding portion of the insulator, protruded from the second end of the metal shell.

When the absolute value of the diameter difference represented by $|B-A|$ is equal to or less than 0.6 mm, the facilitating of the attachment of the plug cap is ensured.

According to another preferred embodiment of the present invention, a dimensional relationship $B>A$ is satisfied, and a diameter difference represented by $(B-A)$ is equal to or less than 0.6 mm.

According to another preferred embodiment of the present invention, an absolute value of a diameter difference represented by $|B-A|$ is equal to or less than 0.4 mm. Therefore, the facilitating of the attachment of the plug cap is further improved.

According to yet another preferred embodiment of the present invention, a diameter C of an inserting portion of the terminal inserted into the insulator, is equal to or less than 3.5 mm.

Generally, the diameter of the insulator at the second end thereof is bigger than the diameter of the terminal. So the diameter of the insulator must be small to minimize the diameter difference, since the terminal diameter is standardized in ISO (International Organization for Standardization). However, minimizing the diameter of the insulator protruded from the metal shell in this manner would cause a temperature rise of the insulator, and a temperature rise of the insulator not only accelerates deterioration of the plug cap but also induces flashover. In short, the higher the temperature of the insulator, the lower the insulating resistance of the insulator.

Therefore, the spark plug must be designed so as to suppress a temperature rise of the insulator even when the insulator is minimized.

When a diameter C of the insulator is equal to or less than 3.5 mm, according to this embodiment of the invention, a temperature rise of the insulator is suppressed. Thus, the spark plug of the present invention suppresses a temperature rise of the insulator, so that the spark plug improves heat-durability of the plug cap and prevents electrical deterioration, thereby suppressing flashover.

Furthermore, although minimizing the outer diameter of the insulator is likely to induce a strength reduction of the insulator, the advantage of the present invention of suppressing a temperature rise prevents the strength reduction caused by heat.

According to another preferred embodiment of the present invention, a length L of a protruding portion of the insulator protruded from the metal shell is equal to or greater than 15 mm. When a length L is equal to or greater than 15 mm, flashover is suppressed.

According to another preferred embodiment of the present invention, the length L is equal to or less than 30 mm. If the length L of the insulator is too long, it is difficult to ensure the strength of the insulator. Therefore, the length L is equal to or less than 30 mm for ensuring the strength.

According to another preferred embodiment of the present invention, a first noble metal chip joined to the first end of the center electrode, the first noble metal chip of the center electrode has a cross-sectional area in a range of 0.07 to 0.40 $mm^2$. By specifying the dimensional range of cross-sectional area of the first noble metal chip as above, a space available for ignition in the spark gap is secured and a required spark plug voltage is reduced, while the first noble metal chip is not so thin as to be worn down easily.

According to another preferred embodiment of the present invention, the first noble metal chip of the center electrode is made of an Ir-based alloy including Ir in an amount of greater than 50 weight percent and at least one additive, the Ir-based alloy having a melting point of greater than 2000 degrees Celsius.

According to another preferred embodiment of the present invention, the noble metal chip of the center electrode including at least one additive is selected from Pt, Rh, Ni, W, Pd, Ru, Re, Al, $Al_2O_3$, Y, $Y_2O_3$. By specifying the materials of the first noble metal chip, a long service life can be secured for the first noble metal chip.

According to another preferred embodiment of the present invention, a second noble metal chip is joined to the ground electrode so that the second noble metal chip of the ground electrode is opposed to the first end of the center electrode, the second noble metal chip of the ground electrode has a cross-sectional area in a range of 0.12 to 0.80 $mm^2$, the second noble metal chip of the ground electrode has a protrusion length from the ground electrode in a range of 0.3 to 1.5 mm, and a spark gap between the center electrode and the ground electrode is in a range of 0.4 to 0.8 mm.

When the spark gap between the center electrode and the ground electrode is in a range of 0.4 to 0.8 mm, a required spark voltage is reduced.

When the spark gap is reduced, it is difficult to ensure a space available for ignition. However, since the spark plug in this embodiment has the second noble metal chip having small diameter, the spark plug can be ignited and reduced the required spark voltage. And when a cross-sectional area and a protrusion length of the second noble metal chip is above mentioned value, the spark plug is ensured the space available for ignition and the long service life of the second noble metal chip.

According to another preferred embodiment of the present invention, the second noble metal chip of the ground electrode is made of a Pt-based alloy including Pt in an amount of greater than 50 weight percent and at least one additive having a melting point of greater than 1500 degrees Celsius.

According to another preferred embodiment of the present invention, the second noble metal chip of the ground electrode including at least one additive is selected from Ir, Rh, Ni, W, Pd, Ru, Re.

By specifying the materials of the second noble metal chip, a long service life can be secured for the second noble metal chip.

According to another preferred embodiment of the present invention, the second end of the terminal is capable of attaching an ignition coil.

BRIEF DESCRIPTION OF THE DRAWINGS

The present invention will be understood more fully from the detailed description given hereinafter and from the accompanying drawings of the preferred embodiments of the invention, which, however, should not be taken to limit the invention to the specific embodiments but are for the purpose of explanation and understanding only.

In the accompanying drawings.

DETAILED DESCRIPTION OF EMBODIMENT

An embodiment of the present invention will be described hereinafter with reference to the drawings.

Figure 1:
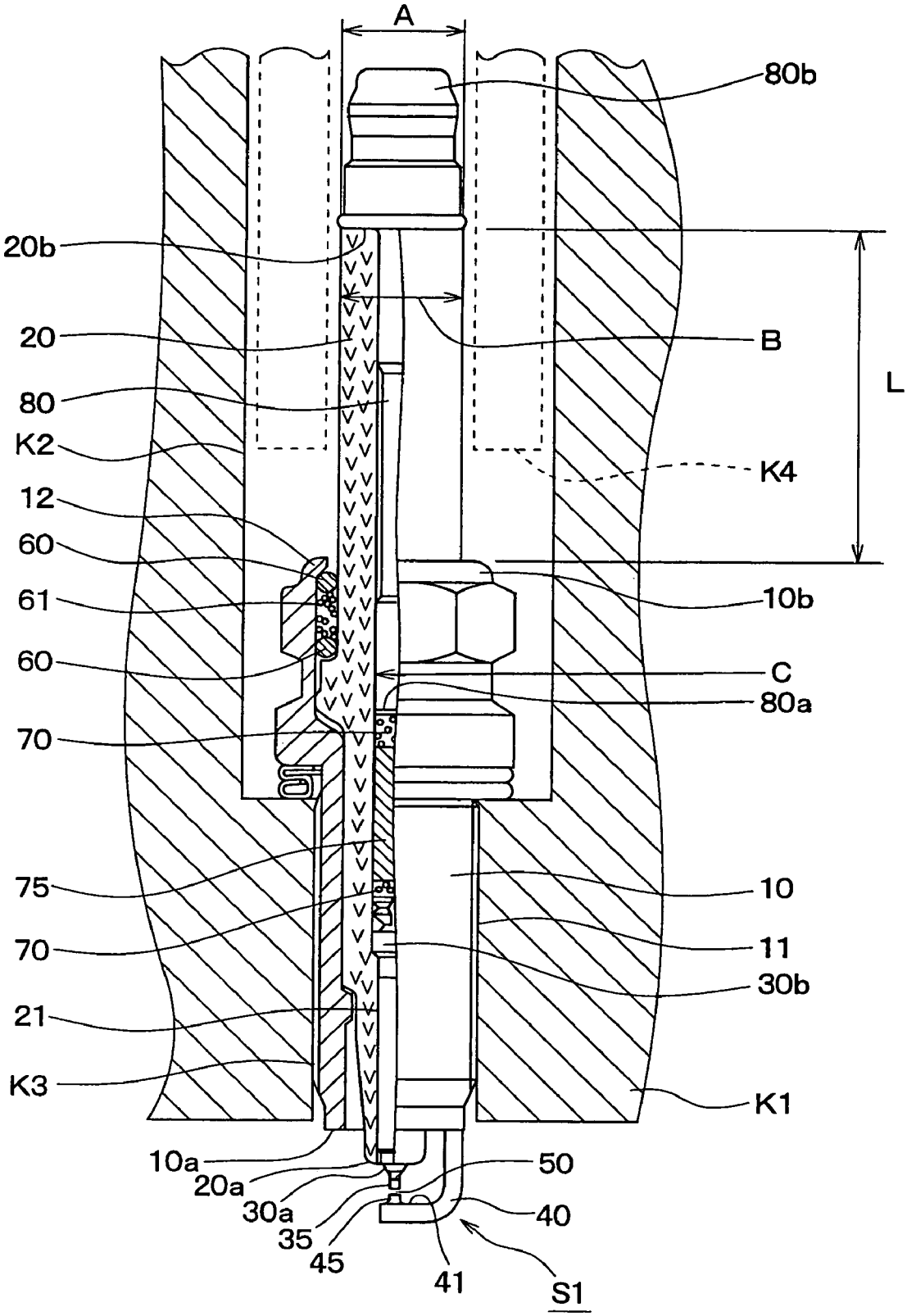
FIG. 1 is a partially cross-sectional side view showing an overall structure of a spark plug embodying the invention.
Figure 2:
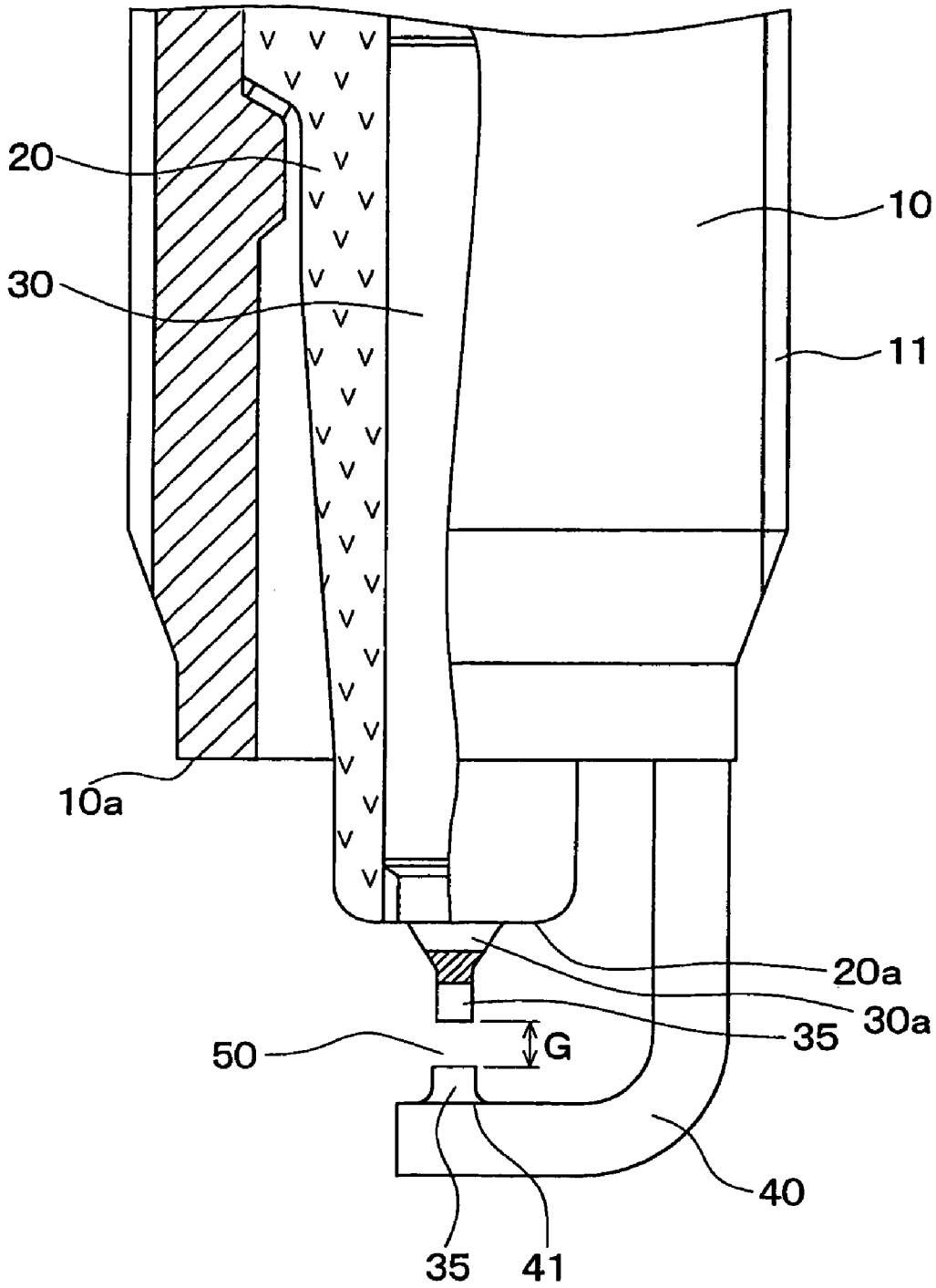
FIG. 2 is an enlarged side view partially in cross-section showing a spark gap and the proximity thereof in the spark plug of FIG. 1.

FIG. 1 is a partially cross-sectional side view showing an overall structure of a spark plug S1 of the present invention. FIG. 2 is an enlarged side view partially in cross-section showing a spark gap and the proximity thereof in the spark plug S1. The spark plug S1 is designed to be used for internal combustion engines of automotive vehicles.

As shown in FIG. 1, the spark plug S1 is inserted into a plug hole K2 formed on an engine head K1 forming a combustion chamber of an engine, the spark plug S1 is fixed to a threaded opening K3 of the plug hole K2.

The spark plug S1 includes a metal shell 10, an insulator 20, a center electrode 30, and a ground electrode 40.

The metal shell 10, which has a cylindrical shape, is made of conductive metal material, for example low-carbon steel. The metal shell 10 has a threaded portion 11 on the outer periphery thereof for fitting the spark plug S1 into the threaded opening K3. The threaded portion 11 of the metal shell 10 has an outer diameter in the range of 10 mm or less.

This range corresponds to the range of M10 or less in accordance with JIS (Japanese Industrial Standards).

The tubular insulator 20, which is made of alumina ceramic ($Al_2O_3$), is fixed and partially contained in the metal shell 10. A first end 20*a* of the insulator 20 protrudes from a first end 10*a* of the metal shell 10 and a second end b 20*b* of the insulator 20 protrudes from a second end 10*b* of the metal shell 10.

The center electrode 30 is secured in a bore 21 of the insulator 20, so that it is isolated from the metal shell 10. The cylindrical center electrode 30 is made of a highly heat conductive metal material such as Cu as the core material and a highly heat-resistant, corrosion-resistant metal material such as Ni (Nickel)-based alloy as the clad material.

As shown in FIG. 1, a first end 30*a* of the center electrode 30 protrudes from the first end 20*a* of the insulator 20. The center electrode 30 is secured in the metal shell 10 and is isolated from the metal shell 10 so that the first end 30*a* of the center electrode 30 protrudes from the first end 10*a* of the metal shell 10.

The ground electrode 40, which is made of a Ni-based alloy consisting mainly of Ni, is column-shaped, for example the ground electrode 40 is rectangular-column-shaped in this embodiment. The ground electrode 40 has a one end joined, for example by welding, to the first end 10*a* of the metal shell 10. A middle portion of the ground electrode 40 is bent in an approximate L-shape. The other end of the ground electrode 40 has a side surface 41 that is opposed to the first end 30*a* of the center electrode 30.

A first noble metal chip 35 is joined, for example by laser welding or resistance welding, to the first end 30*a* of the center electrode 30 as a sparking member. A second noble metal chip 45 is joined, for example by laser welding or resistance welding, to the side surface 41 of the ground electrode 40, which corresponds to a surface facing the first end 30*a* of the center electrode 40.

Both of these noble metal chips 35 and 45 have a cylindrical shape. A spark gap 50 is defined by a clearance between the first noble metal chip 35 and the second noble metal chip 45. The spark gap is preferably in the range of 0.4 mm to 0.8 mm.

The cross sectional area of the first noble metal chip 35, orthogonal to a central axis of the first noble metal chip 35, is preferably in the range of 0.07 $mm^2$ to 0.40 $mm^2$. The first noble metal chip 35 is made of an Ir (Iridium)-based alloy including Ir in an amount of greater than 50 weight percent and at least one additive, which preferably the melting point of the alloy is greater than 2000 degrees Celsius. Furthermore, at least one additive is preferably selected from Pt (Platinum), Rh (Rhodium), Ni, W (Tungsten), Pd (Palladium), Ru (Ruthenium), Re (Rhenium), Al (Aluminum), $Al_2O_3$ (Alumina), Y (Yttrium), $Y_2O_3$ (Yttria).

The cross sectional area of the second noble metal chip 45, orthogonal to a central axis of the second noble metal chip 45, is preferably in the range of 0.12 $mm^2$ to 0.80 $mm^2$. A protrusion length of the second noble metal chip 45 from the side surface 41 of the ground electrode 40 is preferably in the range of 0.3 to 1.5 mm. The second noble metal chip 45 is preferably made of a Pt-based alloy including Pt in an amount of greater than 50 weight percent and at least one additive. The melting point of the Pt-based alloy is greater than 1500 degrees Celsius. Furthermore, the at least one additive for the second noble metal chip 45 is preferably selected from Ir, Rh, Ni, W, Pd, Ru, Re.

As shown in FIG. 1, the insulator 20 is partially inserted into the metal shell 10. The insulator 20 is fastened with a crimping portion 12 formed at the second end 10*b* of the metal shell 10.

Seal members 60, 61 are disposed inside a space enclosed with the metal shell 10 and the insulator 20 for sealing between the metal shell 10 and the insulator 20. The seal members 60, 61 comprise two metal rings 60 and talc 61 in this embodiment.

As shown in FIG. 1, the second end 30*b* of the center electrode 30 is electrically connected to a resister 75 through a conductive glass seal 70 in the bore 21. Further as shown in FIG. 1, the resister 75 is electrically connected to a first end 80*a* of a terminal (stem) 80 through the conductive glass seal 70 in the bore 21 at the second end 20*b* of the insulator 20.

A second end 80*b* of a terminal 80 protrudes from the second end 20*b* of the insulator 20. A plug cap K4 (which is shown in FIG. 1 with a dashed line) of an ignition coil is capable of attaching to the second end 80*b* of the terminal 80.

A first end 80*a* of the terminal 80 is electrically connected to the second end 30*a* of the center electrode 30 in the insulator 20. The terminal 80 is partially inserted into the bore 21. The terminal 80 is fixed to the insulator 20 so that the second end 80*b* of the terminal 80 protrudes from the second end 20*b* of the insulator 20.

The plug cap K4 is made of highly heat-resistant resin. As shown in FIG. 1, the second end 80*b* of the terminal 80 and a protruding portion of the insulator 20 protruded from the metal shell 10 are inserted into a hole of the plug cap K4.

Generally, the plug cap K4 is attached to the spark plug so that an end of the plug cap K4 is located at a point that is closer to the metal shell 10 than the axial midpoint in the protruding portion of the insulator 20. For example, an end of the plug cap K4 is located at a distance of 3 mm from the second end 10*b* of the metal shell 10.

The spark plug S1 is inserted into the plug hole K2 and fixed to the engine head K1 with a thread fitting between the treaded portion 11 and the threaded opening K3.

The ignition coil (not shown) is electrically connected to the second end 80*b* of the terminal 80 through the plug cap K4.

More specifically, the ignition coil is inserted into the plug hole K2. The second end 80*b* of the terminal 80 and the second end 20*b* of the insulator 20, which protrudes from the second end 10*b* of the metal shell 10, are inserted into the plug cap K4, so that the ignition coil is electrically connected to the spark plug S1.

The metal shell 10 fitted to the engine head K1 and the ground electrode 40 are connected to ground. The center electrode 30 is provided high voltage through the terminal 80 from the ignition coil. Consequentially spark discharge takes place between the first noble metal chip 35 and the second noble metal chip 45, so that combustion take place in the engine.

The dimensional parameters designated as A, B in FIG. 1 will be defined and described hereinafter.

A is a maximum diameter of a protruding portion of the terminal 80, protruded from the insulator 20.

B is a diameter of a protruding portion of the insulator 20, protruded from the metal shell 10.

Additionally, a combination parameter represented by $|B-A|$ has been employed to investigate how to effectively facilitate the attachment of the plug cap K4 to the spark plug S1.

The parameter |B−A|, which characterizes the structure of the spark plug S1 according to this embodiment, has been determined based on the investigation results from the inventor as follows.

At first the inventor of the present invention investigated the range of the parameter |B−A| for facilitating the attachment of the plug cap K4.

For this investigation, the inventor prepared sample spark plugs varying the diameter B, and the inventor considered a relationship between the parameter |B−A| and facilitating the attachment of the plug cap K4.

In this embodiment, the maximum diameter A of the terminal is maintained as 7.0 mm and the diameter B of the insulator is varied among 10.0 mm, 9.0 mm, 8.0 mm, 7.6 mm, 7.4 mm, 7.2 mm and 7.0 mm.

Figure 3:
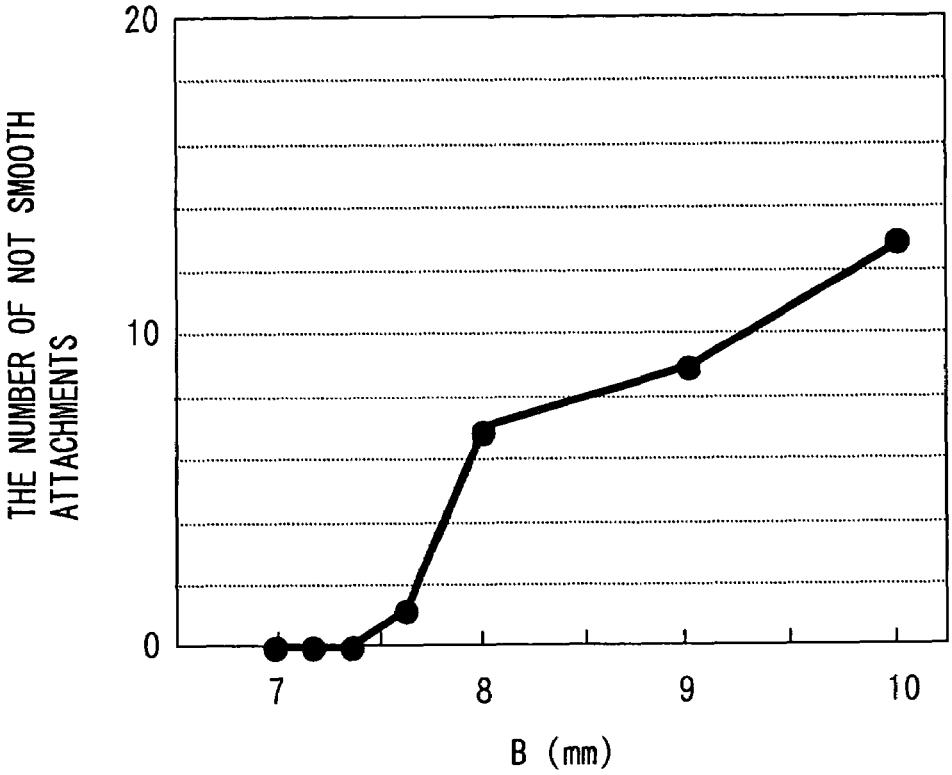
FIG. 3 is a graphical representation showing the relationship between a diameter B and the number of not smooth attachments.

Thirty units (30 units) of each sized spark plug were tested in respect to facilitating the attachment of the plug cap K4. FIG. 3 shows the number of not smooth attachments, for example catching, while the plug cap K4 was attaching.

FIG. 3 shows the relationship between the diameter B and the number of not smooth attachments. As shown in FIG. 3, when the insulator diameter is equal to or less than 7.6 mm, the number of not smooth attachments is small, and when the diameter is equal to or less than 7.4 mm, the number of not smooth attachments is zero (0).

Thus, when the insulator diameter is bigger than the terminal diameter 80, if the parameter B−A is equal to or less than 0.6 mm, attachment is facilitated. Preferably the parameter B−A is equal to or less than 0.4 mm or less.

When the diameter of the insulator is smaller than the diameter of the terminal, there is no problem with the attachment of the plug cap K4. However, the detachment of the plug cap K4 should be considered.

In case like this, the inventor considered the parameter A−B should be the same value as mentioned above, so the parameter A−B is also equal to or less than 0.6 mm (preferably 0.4 mm).

Accordingly, the parameter |B−A| should be equal to or less than 0.6 mm, based on the investigation results mentioned above.

The spark plug facilitating the attachment and the detachment of the plug cap K4 in this embodiment does not induce that the ignition coil to separates from the spark plug during use. Because the ignition coil is mounted to the engine head K1, for example with a bolt.

The second end 20*b* of the insulator 20 in this embodiment is minimized compared to conventional spark plugs. However, such minimizing is likely to induce deterioration of the plug cap K4 as a result of a temperature rise of the insulator 20 and a breakage of the insulator 20 as a result of a strength reduction.

Therefore, the relationship between the diameter C, which is a diameter of an inserting portion of the terminal 80 inserted into the insulator 20, and the temperature rise of the insulator 20 have been experimentally determined.

In this embodiment, the diameter B of the insulator is maintained as 7.4 mm and the diameter C is varied among 4.0 mm, 3.7 mm, 3.4 mm, 3.1 mm, and 2.8 mm.

Two units (2 units) of each sized spark plug were tested in respect to the temperature rise of the insulator 20.

A measurement point of a temperature rise is located at a distance of 3 mm from the second end 10*b* of the metal shell 10. The measurement point is to be the highest temperature point in the plug cap K4, which corresponds to an end of the plug cap K4.

Figure 4:
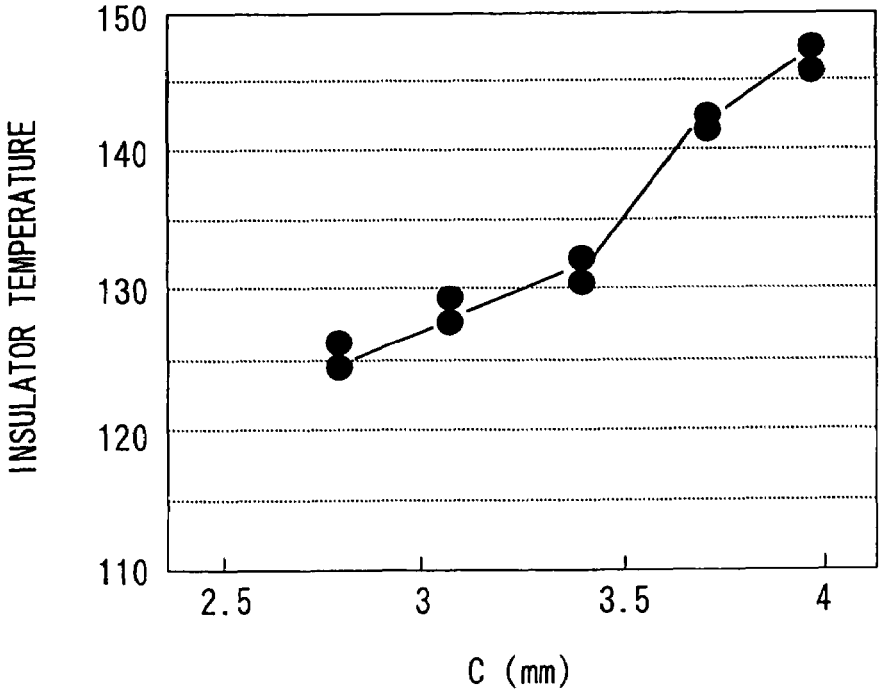
FIG. 4 is a graphical representation showing the relationship between a diameter C and a temperature at the second end of the insulator.

FIG. 4 shows the result of this investigation. The engine tested had six cylinders and a capacity of 2 liters, and the test was conducted under conditions of a full throttle acceleration of 5000 rpm. Specifically FIG. 4 shows the relationship between the diameter C and the temperature rise of the insulator 20.

It can be seen from FIG. 4 that when the diameter C is small, the temperature of the insulator 20 is low, and when the diameter C is equal to or less than 3.5 mm, the temperature of the insulator 20 kept at a low level. Therefore, based on the above mentioned investigation results, the diameter C should be equal to or less than 3.5 mm. In this embodiment, the inserting portion of the terminal 80 has a substantially constant diameter, which is equal to or less than 3.5 mm.

The inventor considered minimizing the inserting portion of the terminal 80 to suppress heat-conducting from the combustion chamber to the terminal 80. The diameter C is desirably small from the aspect of the suppressing temperature rise. However, the diameter C is preferably equal to or greater than 2.0 mm from the aspect of the strength of the insulator 20 and the center electrode 30.

The spark plug of the present invention suppresses the temperature rise of the insulator 20, so that the spark plug improves heat-durability of the plug cap K4 and prevents from electrically deterioration for suppressing flashover. Although minimizing the diameter of the insulator 20 is likely to induce a strength reduction of the insulator 20, the advantage of the present invention of suppressing the temperature rise prevents the strength reduction caused by heat of the insulator 20.

Since the present invention suppresses flashover, a length L of the protruding portion of the insulator 20 protruded from the metal shell 10 can be shortened. Therefore, the relationship between the length L and the flashover have been experimentally determined.

In this embodiment, the diameter B of the insulator 20 is maintained as 7.4 mm, the diameter C of the terminal 80 is maintained as 3.1 mm, and the length L is varied among 10 mm, 15 mm, 20 mm, and 25 mm.

Each sized spark plug was tested in respect to the occurrence of the flashover.

The engine tested had six cylinders and a capacity of 2 liters, and the test was conducted for 50 hours under conditions of repeating alternately an idling for 1 minute and a full throttle acceleration of 5000 rpm for 1 minute. This condition gives heat-cool cycle to the spark plug S1. This condition accelerates the deterioration of the plug cap K4 and induces the flashover, when the mode of the engine is changed from the idling to the full throttle.

Figure 5:
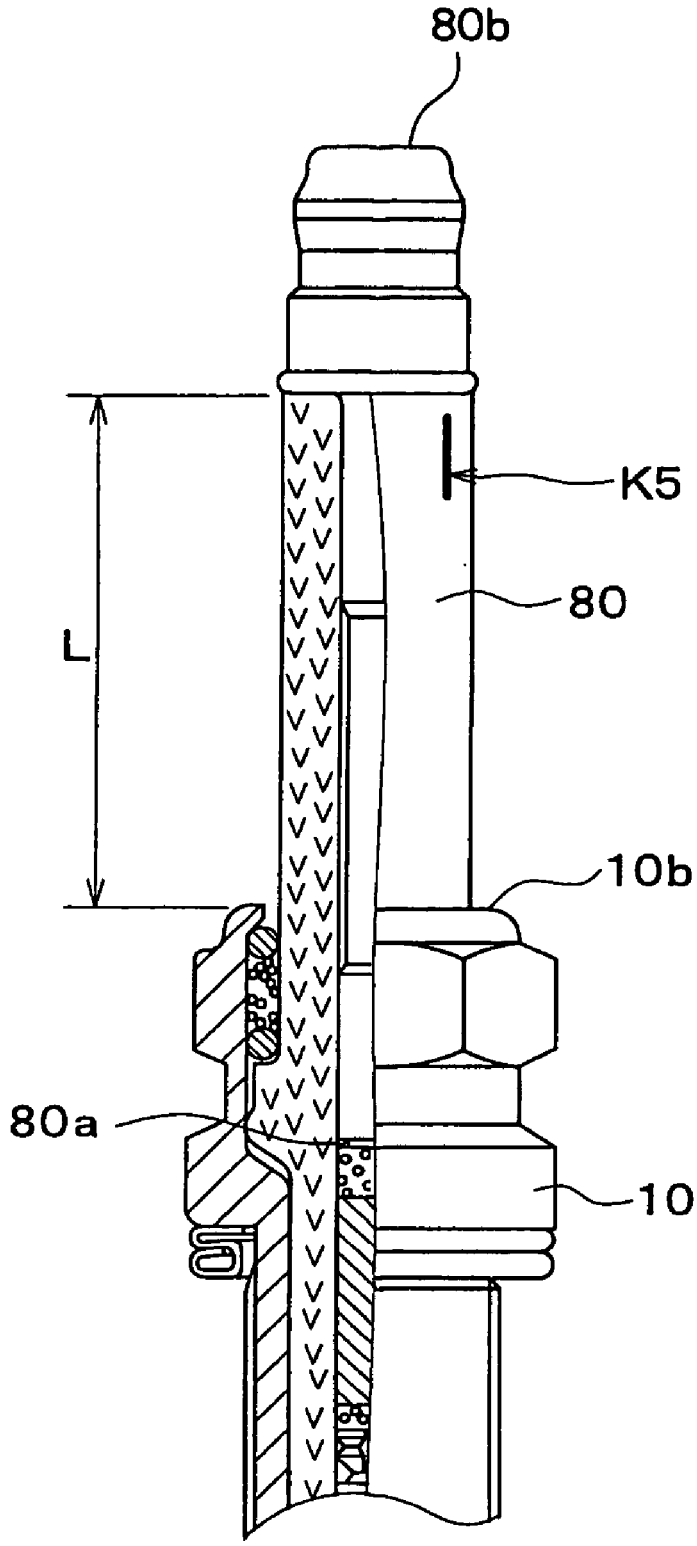
FIG. 5 is an illustration for showing flashover vestige remaining on the surface of the insulator.

As shown in FIG. 5, the occurrence of the flashover is evaluated from spark vestige K5 on the surface of the insulator 20.

Table 1 shows the relationship between the insulator length L and the occurrence of the flashover.

TABLE 1

| | Length L (mm) | | | |
|---|---|---|---|---|
| | 10 | 15 | 20 | 25 |
| Flashover | occurred | NOT occurred | NOT occurred | NOT occurred |

It can be seen from Table 1, when the Length L is equal to or greater than 15 mm, flashover did not occur. However, if the length L of the insulator is too long, it is difficult to ensure the strength of the insulator. Since the spark plug has a structure for facilitating the attachment in this embodiment, the length is also equal to or less than 30 mm, so that a cracking of the insulator does not occur.

Preferably, in this embodiment, the center electrode 30 comprises a noble metal chip 35 joined to the first end of the center electrode 30. The noble metal chip 35 has a cross-sectional area in a range of 0.07 to 0.40 $mm^2$. By specifying the dimensional range of cross-sectional area of the first noble metal chip 35 as above, the space available for ignition in the spark gap 50 is secured and the required spark voltage is reduced, while the first noble metal chip 35 is not so thin as to be worn down easily.

The noble metal chip of the center electrode is made of an Ir-based alloy including Ir in an amount of greater than 50 weight percent and at least one additive. The Ir-based alloy has a melting point of greater than 2000 degrees Celsius. The noble metal chip including at least one additive is selected from Pt, Rh, Ni, W, Pd, Ru, Re, Al, $Al_20_3$, Y, $Y_20_3$. By specifying the material of the first noble metal chip 35, a long service life can be secured for the center electrode 30.

A second noble metal chip 45 is joined to the ground electrode so that the second noble metal chip 45 opposed to the first end 30*a* of the center electrode 30. The second noble metal chip 45 has a cross-sectional area in a range of 0.12 to 0.80 $mm^2$. The noble metal chip has a protrusion length from the ground electrode in a range of 0.3 to 1.5 mm. The spark gap between the center electrode and the ground electrode is in a range of 0.4 to 0.8 mm. When the space of the spark gap 50 between the center electrode and the ground electrode is in a range of 0.4 to 0.8 mm, the required spark voltage is reduced.

When the spark gap 50 is reduced, it is difficult to ensure the space available ignition. However, since the spark plug in this embodiment has the second noble metal chip 45 having small diameter, the spark plug can be ignited and a required spark voltage is reduced.

The second noble metal chip 45 of the ground electrode 40 is made of a Pt-based alloy including Pt in an amount of greater than 50 weight percent and at least one additive having a melting point of greater than 1500 degrees Celsius. The second noble metal chip 45 including at least one additive is selected from Ir, Rh, Ni, W, Pd, Ru, Re. By specifying the material of the second noble metal chip 45, a long service life can be secured for the ground electrode 40.

While the above particular embodiments of the invention have been shown and described, it will be understood by those who practice the invention and those skilled in the art that various modifications, changes, and improvements may be made to the invention without departing from the spirit of the disclosed concept.

For example, in the previous embodiments, the center electrode 30 and the ground electrode 40 may not include the noble metal chip. Moreover, except the essential dimensional relationships specified in the previous embodiments, other detailed dimensional ranges and/or relationships may be suitably modified, or changed in designing the spark plugs.

Such modifications, changes, and improvements within the skill of the art are intended to be covered by the appended claims.

Thus, the present invention should not be limited to the disclosed embodiments, but may be implemented in other ways without departing from the spirit of the invention.

What is claimed is:

1. A spark plug comprising:

a metal shell having a first end and a second end, the metal shell also having a threaded portion on an outer periphery thereof;

an insulator having a first end and a second end, the insulator also having a bore formed therein, the insulator being fixed in the metal shell so that the first end of the insulator protrudes from the first end of the metal shell and the second end of the insulator protrudes from the second end of the metal shell;

a center electrode secured in the bore of the insulator, the center electrode having a first end protruding from the first end of the insulator and a second end;

a ground electrode joined to the first end of the metal shell so that the ground electrode is opposed to the center electrode through a spark gap;

a terminal having a first end and a second end, the terminal being partially inserted into the bore and fixed to the insulator so that the first end of the terminal electrically connects to the second end of the center electrode and the second end of the terminal protrudes from the second end of the insulator; and wherein an absolute value of a diameter difference represented by $|B-A|$ is equal to or less than 0.6 mm, where A is a maximum diameter of a protruding portion of the terminal, protruded from the second end of the insulator, and B is a diameter of a protruding portion of the insulator, protruded from the second end of the metal shell.

2. The spark plug according to claim 1, wherein a dimensional relationship $B>A$ is satisfied, and a diameter difference represented by $(B-A)$ is equal to or less than 0.6 mm.

3. The spark plug according to claim 1, wherein an absolute value of a diameter difference represented by $|B-A|$ is equal to or less than 0.4 mm.

4. The spark plug according to claim 1, wherein a diameter C of an inserting portion of the terminal inserted into the insulator, is equal to or less than 3.5 mm.

5. The spark plug according to claim 1, wherein a length L of a protruding portion of the insulator protruded from the metal shell is equal to or greater than 15 mm.

6. The spark plug according to claim 5, wherein the length L is equal to or less than 30 mm.

7. The spark plug according to claim 1, wherein a first noble metal chip joined to the first end of the center electrode, the first noble metal chip of the center electrode has a cross-sectional area in a range of 0.07 to 0.40 $mm^2$.

8. The spark plug according to claim 7, wherein the first noble metal chip of the center electrode is made of an Ir-based alloy including Ir in an amount of greater than 50 weight percent and at least one additive, the Ir-based alloy having a melting point of greater than 2000 degrees Celsius.

9. The spark plug according to claim 8, wherein the first noble metal chip of the center electrode including at least one additive is selected from Pt, Rh, Ni, W, Pd, Ru, Re, Al, $Al_20_3$, Y, $Y_20_3$.

10. The spark plug according to claim 1, wherein a second noble metal chip is joined to the ground electrode so that the second noble metal chip of the ground electrode is opposed to the first end of the center electrode, the second noble metal chip of the ground electrode has a cross-sectional area in a range of 0.12 to 0.80 $mm^2$, the second noble metal chip of the ground electrode has a protrusion length from the ground electrode in a range of 0.3 to 1.5 mm, and a spark gap between the center electrode and the ground electrode is in a range of 0.4 to 0.8 mm.

11. The spark plug according to claim 10, wherein the second noble metal chip of the ground electrode is made of an Pt-based alloy including Pt in an amount of greater than 50 weight percent and at least one additive having a melting point of greater than 1500 degrees Celsius.

12. The spark plug according to claim 11, wherein the second noble metal chip of the ground electrode including at least one additive is selected from Ir, Rh, Ni, W, Pd, Ru, Re.

13. The spark plug according to claim 1, wherein the second end of the terminal is capable of attaching an ignition coil.

* * * * *